United States Patent [19]

Dotson et al.

[11] 4,055,475

[45] Oct. 25, 1977

[54] METHOD FOR OPERATING ELECTROLYTIC DIAPHRAGM CELLS

[75] Inventors: Ronald L. Dotson; David D. Justice; Han C. Kuo, all of Cleveland, Tenn.

[73] Assignee: Olin Corporation, New Haven, Conn.

[21] Appl. No.: 660,959

[22] Filed: Feb. 24, 1976

[51] Int. Cl.[2] ..... C25B 1/26; C25C 1/16

[52] U.S. Cl. ..... 204/98; 204/128

[58] Field of Search ..... 204/128, 98, 296

[56] References Cited

U.S. PATENT DOCUMENTS

| | | | |
|---|---|---|---|
| 3,282,875 | 11/1966 | Connolly et al. | 260/29.6 |
| 3,773,634 | 11/1973 | Stacey et al. | 204/98 |
| 3,853,720 | 12/1974 | Korach et al. | 204/295 |

OTHER PUBLICATIONS

"Chlorine" by Sconce, 1962, p. 105.

*Primary Examiner*—R. L. Andrews

*Attorney, Agent, or Firm*—James B. Haglind; Donald F. Clements; Thomas P. O'Day

[57] ABSTRACT

The electrolysis of alkali metal chloride solutions in a diaphragm cell having an anode compartment separated from a cathode compartment by a porous perfluorosulfonic acid resin diaphragm is optimized by maintaining the pH of the alkali metal chloride solution in the range of from about 3.0 to about 5.0. In this pH range, highly desirable bulk flow properties are obtained by controlling the dimensional stability of the perfluorosulfonic acid resin.

11 Claims, 2 Drawing Figures

METHOD FOR OPERATING ELECTROLYTIC DIAPHRAGM CELLS

This invention relates to a method for the electrolysis of alkali metal chloride solutions. More particularly, this invention is related to a method for the electrolysis of alkali metal chloride solutions in electrolytic diaphragm cells.

Production of chlorine and alkali metal hydroxides in diaphragm cells which electrolyze alkali metal chloride solutions has been a commercially important process for a number of years. The diaphragm cell employs an anode and a cathode separated by a fluid permeable diaphragm. Maintenance of the desired fluid permeability of the diaphragm is an economically desirable aspect in the operation of the diaphragm cell. Thus dimensional stability is an important property for materials employed as diaphragms. While asbestos has been the primary material employed in diaphragms in commercial chlorine cells, there has been an extensive search for materials having improved cell life and ionic selectivity. A large number of compositions have been proposed, particularly organic compounds such as vinyl chloride, acrylic acid, tetrafluoroethylene, ethylene, and styrene, among others which have been employed in polymers and copolymers. Recently perfluorosulfonic acid resins have been developed which have favorable ion exchange properties and which are inert to the alkali metal chloride electrolytes.

When employed as porous diaphragms, these materials can suffer reduced dimensional stability during cell operation that results in reduced current efficiency and erratic operating conditions within the cell.

There is, therefore, need for a method of operating diaphragm cells which inhibits the loss of dimensional stability of the porous diaphragm materials employed.

It is an object of the present invention to provide a method of operating an electrolytic diaphragm cell which promotes control of the dimensional stability of porous diaphragm materials.

An additional object of the present invention is to provide a method of operating an electrolytic diaphragm cell which provides optimum flow characteristics for porous diaphragm materials.

These and other objects of the invention are accomplished in a method for controlling the flow properties of a porous diaphragm in an electrolytic cell for producing chlorine gas and a caustic liquor by the electrolysis of an alkali metal chloride solution. The electrolytic cell is comprised of an anode compartment containing the alkali metal chloride solution and a cathode compartment containing the caustic liquor. The anode compartment is separated from the cathode compartment by the porous diaphragm comprised of a perfluorosulfonic acid resin. The method is characterized by the improvement which comprises maintaining the pH of the alkali metal chloride solution in the anode compartment at from about 3.0 to about 5.0.

More in detail, diaphragm materials which are porous in nature permit bulk flow of liquids from the anode compartment to the cathode compartment in the diaphragm cell. The rate of flow should be sufficient to overcome, for example, the back migration of hydroxyl ions. During operation of the cell, the dimensional stability of porous diaphragm materials changes, for example, by swelling or contracting and this alters the rate of bulk flow through the diaphragm. For example, an asbestos diaphragm undergoes considerable swelling when employed in the electrolysis of alkali metal chloride solutions which results in a service life of only a few months. Synthetic materials such as polyacrylate or perfluorosulfonic acid resins are basically more dimensionally stable, but can undergo swelling when employed as porous diaphragm materials, this swelling interferes with the efficient operation of the cell as the pore area changes.

Figure 1:
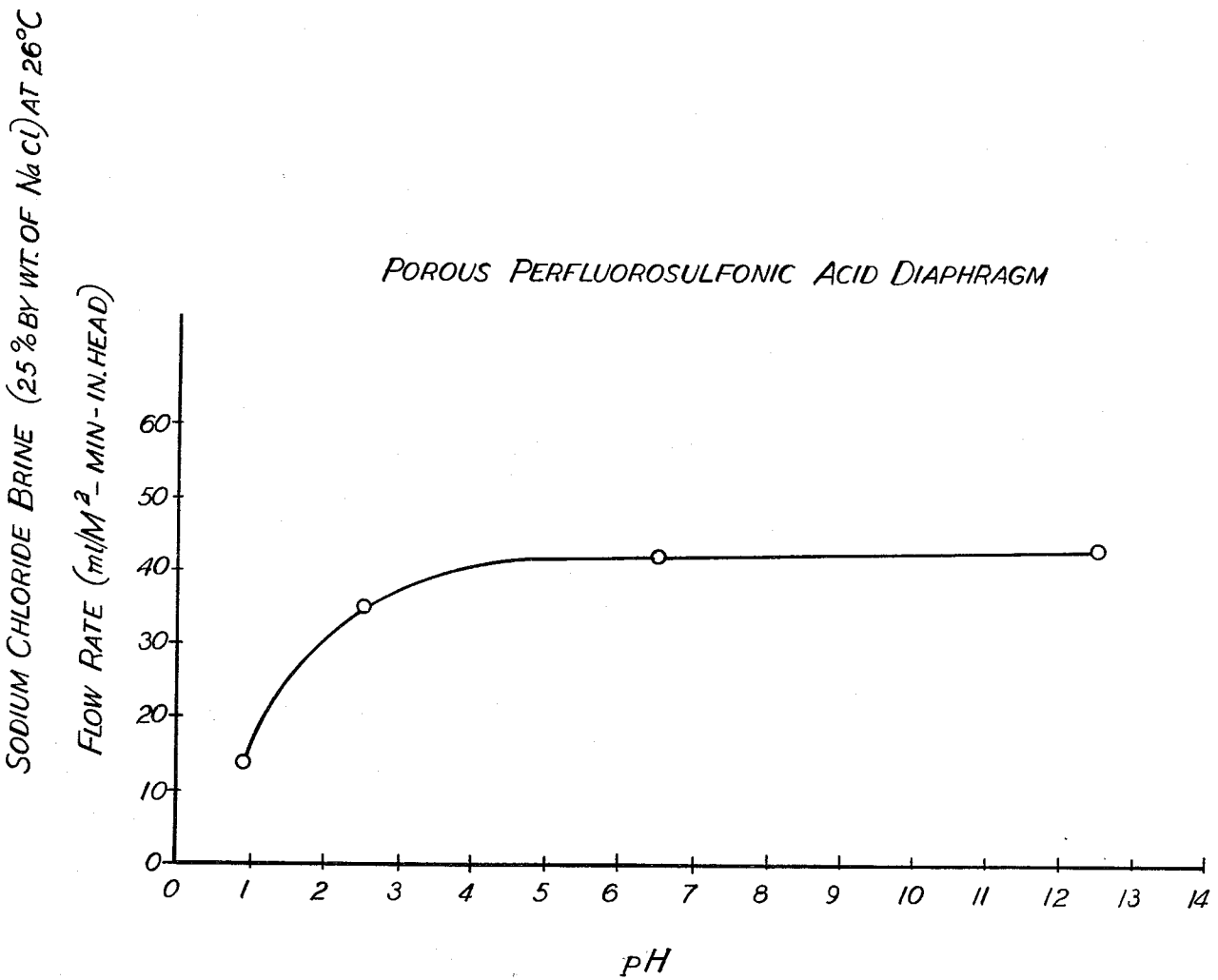
FIG. 1 is a graph relating flow properties of sodium chloride brine through a porous perfluorosulfonic acid diaphragm to the brine pH and showing the optimum values for brine flow at a pH above about 3.0, as determined in Example 1.

A suitable cationic porous diaphragm is comprised of a solid perfluorosulfonic acid resin reinforced by a screen of a suitable metal or a fabric such as a polyfluoroolefin cloth. The perfluorosulfonic acid resins are preferably hydrolyzed copolymers of a perfluoroolefin and a fluorosulfonated perfluorovinyl ether. Suitable perfluoroolefins include tetrafluoroethylene, hexafluoropropylene, octafluorobutylene and higher homologues. Preferred perfluoroolefins include tetrafluoroethylene and hexafluoropropylene, with tetrafluoroethylene being particularly preferred. The fluorosulfonated perfluorovinyl ethers are compounds of the formula $FSO_2CFRCF_2O[CFYCF_2O]_nCF{=}CF_2$(I), where R is a radical selected from the group consisting of fluorine and perfluoroalkyl radicals having from 1 to about 8 carbon atoms, Y is a radical selected from the group consisting of fluorine and trifluoromethyl radicals; and $n$ is an integer of 0 to about 3. Illustrative of such fluorosulfonated perfluorovinyl ethers are:

$FSO_2CF_2CF_2OCF{=}CF_2$,
$FSO_2CF_2CF_2OCF(CF_3)CF_2OCF(CF_3)CF_2OCF{=}CF_2$, $FSO_2CF_2CF_2CF_2CF_2OCF(CF_3)CF_2OCF{=}CF_2$,
and
$FSO_2CF_2CF_2OCF(CF_3)CF_2OCF{=}CF_2$.

Preferred sulfonated perfluorovinyl ethers are those of Formula I above in which R is fluorine and Y is trifluoromethyl.

A particularly preferred sulfonated perfluorovinyl ether is that of the formula:

$FSO_2CF_2CF_2OCF(CF_3)CF_2OCF{=}CF_2$, perfluoro [2-(2-fluorosulfonylethoxy)propyl vinyl ether].

The sulfonated perfluorovinyl ethers are prepared by methods described in U.S. Pat. Nos. 3,041,317 to Gibbs et al; 3,282,875 to Connolly et al; 3,560,568 to Resnick; and 3,718,627 to Grot.

The copolymers employed in the cationic persulfonic acid resins of the present invention are prepared by methods described in U.S. Pat. Nos. 3,041,317 to Gibbs et al; 3,282,875 to Connolly et al; and 3,692,569 to Grot.

The solid persulfonic acid resins are prepared by copolymerizing the perfluoroolefin, for example, tetrafluoroethylene with the sulfonated perfluorovinyl ether followed by converting the $FSO_2$ group to $SO_3H$ or a sulfonate group (such as an alkali metal sulfonate) or a mixture thereof. The equivalent weight of the perfluorocarbon copolymer ranges from about 900 to about 1,600, and preferably from about 1,100 to about 1,500. The equivalent weight is defined as the average molecular weight per sulfonyl group.

A particularly preferred cation porous diaphragm is a perfluorosulfonic acid composite diaphragm produced by E. I. DuPont de Nemours and Co. and sold commercially under the trademark "Nafion".

These perfluorosulfonic acid resins have a stable acid form and a stable salt form. The acid form is obtained, for example, by boiling the resin in hydrochloric acid for a short period. An alkali metal salt form can similarly be obtained by heating the resin in an alkali metal hydroxide solution.

The alkali metal salt form of the perfluorosulfonic acid resin may be suitably selected from any of the alkali metals including lithium, sodium, potassium, rubidium, and cesium. It may be desirable to select the alkali metal form of the resin to correspond to the alkali metal of the chloride solution being electrolyzed. Thus, the sodium form of the persulfonic acid resin can be employed when the electrolyte is sodium chloride.

Suitable alkali metal chloride solutions which may be electrolyzed by the method of the present invention include lithium chloride, sodium chloride, potassium chloride, rubidium chloride, and cesium chloride. For commercial reasons, sodium chloride and potassium chloride are preferred with sodium chloride being particularly preferred. The aqueous solution of the alkali metal chloride fed to the anode compartment as chloride brine can be of any suitable concentration, incuding aqueous solutions saturated with the alkali metal chloride. For example, where sodium chloride is the alkali metal chloride, solutions containing from about 50 grams per liter to about 320 grams per liter are suitable, with solutions containing from about 150 to about 320 grams per liter being preferred.

In alkali metal chloride solutions, such as those employed in the anode compartment of a diaphragm cell, it has been discovered that the alkali metal salt form of the perfluorosulfonic acid resin has greater dimensional stability than the acid form of the resin. It has further been discovered that highly desirable bulk flow properties are obtained when at least 95 percent of the perfluorosulfonic acid resin is maintained in the alkali metal salt form. This corresponds to maintaining the pH of the resin at from about 3.0 to about 5.0 by contacting the resin with alkali metal chloride solutions. For example, when sodium chloride is used as the electrolyte, the optimum bulk flow properties of the resin are obtained by controlling the pH of the sodium chloride solution in the range of from about 3.5 to about 4.8, and more preferably at from about 3.6 to about 4.4. Prolonged periods of cell operation with concentrated brines at pH's of below 3.0 result in diaphragm swelling and reduced bulk flow properties. When more dilute brines are used, it is desirable to employ a higher pH, for example, a pH of about 3.5. While the resin remains in the alkali metal form at a pH above about 5.0, the undesirable back migration of hydroxyl ions occurs from catholyte to anolyte and formation of the chlorate results.

Another embodiment of this invention which results in improved bulk flow properties is the control of the alkali metal hydroxide concentration in the caustic liquor produced in the cathode compartment. Where sodium hydroxide is the caustic liquor produced, maintaining the concentration of sodium hydroxide at from about 50 to about 350 grams per liter of NaOH results in favorable bulk flow properties in the perfluorosulfonic acid diaphragm.

While the method of the invention has been described in terms of the preferred perfluorosulfonic acid resins, it will be readily understood that other ion exchange resins may be employed which have a stable acid form and a stable salt form where the resin can be readily converted from one form to the other, for example, polyacrylates.

The following examples are provided to illustrate the invention without any intention of being limited thereby. All parts and percentages are by weight unless otherwise specified.

EXAMPLE 1

A U-shaped cell having a porous perfluorosulfonic acid diaphragm separating the two arms of the "U" was filled with sodium chloride brine at a concentration of 25 percent by weight of NaCl and a temperature of 26° C. Sodium chloride brine of the same concentration as that in the cell but at varying pH's was added to one arm of the "U" while maintaining the head level constant and keeping the rate of addition constant. Brine from the second arm of the "U" was collected and the rate of brine flow through the porous diaphragm determined. The results, shown in FIG. 1, show that the flow rate of brine through the porous diaphragm decreased rapidly below a brine pH of about 3.0.

EXAMPLE 2

Figure 2:
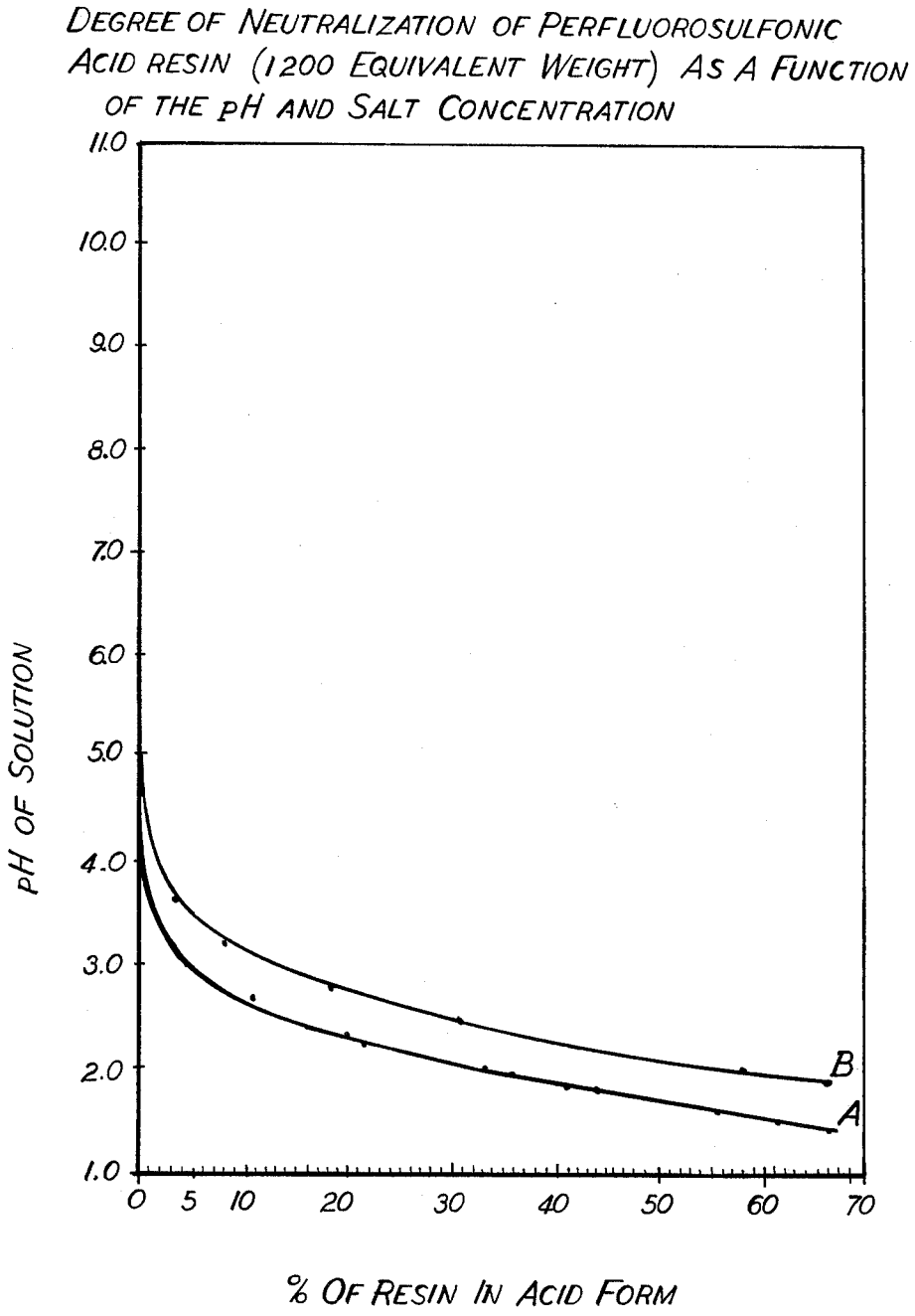
FIG. 2 is a graph illustrating the degree of neutralization of the perfluorosulfonic acid resin as a function of the pH of sodium chloride brines during its transition from the acid form to the salt form and showing the critical optimum values within the range of the present invention. The particular values are those determined by the method of Examples 2 and 3.

A section of a perfluorosulfonic acid resin having an equivalent weight of 1200 was boiled for about 30 minutes in 1N HCl and then washed with distilled water until no further color was observed when $AgNO_3$ was added to the wash solution, showing the absence of chloride ions. The acid form of the persulfonic acid resin was then soaked in a sodium chloride solution containing 241 grams per liter of NaCl. The degree of neutralization of the resin as a function of the pH was determined by potentiometric titration with 0.1N NaOH. As shown in curve A of FIG. 2, at a pH of about 3.0, 5 percent of the resin remained in the acid form. Neutralization of the remaining 5 percent of the acid form of the perfluorosulfonic acid resin to the salt form is in the pH range of from about 3.0 to about 4.8. Above a pH of about 4.8, the perfluorosulfonic acid resin is in the salt form.

EXAMPLE 3

The procedure of Example 2 was repeated with the only change being that the resin was soaked in a sodium chloride solution containing about 60 grams per liter. As shown in curve B of FIG. 2, 95 percent of the resin is converted to the salt form at a pH of about 3.5, the remaining conversion to the salt form taking place in the pH range between about 3.5 and about 4.8, with the resin being in the salt form above this point.

EXAMPLE 4

An electrolytic diaphragm cell having an anode compartment separated from a cathode compartment was employed in the electrolysis of sodium chloride brine. The anode compartment contained an anode comprised of a titanium mesh electroactively coated with ruthenium dioxide. A mild steel mesh cathode was housed in the cathode compartment. Attached to the cathode to separate the anode compartment from the cathode compartment was a porous diaphragm of perfluorosulfonic acid resin 7 mils in thickness, having an equivalent weight of 1200, and supported by a layer of polytetrafluoroethylene cloth. Sodium chloride brine (310 g. per l) was acidified with HCl to a pH of 4.1 and fed through an inlet into the anode compartment at a temperature of about 90° C. Current was passed through the anode to provide a current density of 2 kiloamperes per square meter of anode surface. Chlorine gas was generated at the anode and hydrogen gas and sodium hydroxide produced at the cathode. The pH of the sodium chloride brine fed to the cell was maintained at about 4.1 with the flow rate of the brine into the anode compartment being constant with respect to the rate and head level. The cell was operated continuously for about three weeks at a cathode current efficiency between 80 and 90 percent and producing sodium hydroxide in a concentration ranging from 65 to 130 grams per liter.

What is claimed is:

1. In a method for controlling the flow properties of a porous diaphragm in an electrolytic cell for producing chlorine gas and a caustic liquor by the electrolysis of an alkali metal chloride solution, said electrolytic cell comprised of an anode compartment containing said alkali metal chloride solution and a cathode compartment containing said caustic liquor, said anode compartment separated from said cathode compartment by said porous diaphragm consisting essentially of a perfluorosulfonic acid ion exchange resin having an acid form and an alkali metal salt form, said method being characterized by the improvement which comprises maintaining the pH of said alkali metal chloride solution in said anode compartment at from about 3.0 to about 5.0.

2. The method of claim 1 in which said perfluorosulfonic acid is comprised of a hydrolyzed copolymer of a perfluoroolefin and a fluorosulfonated perfluorovinyl ether of the formula $FSO_2CFRCF_2O[CFYCF_2O]_nCF{=}CF_2$ where R is a radical selected from the group consisting of fluorine and perfluoroalkyl radical having from 1 to about 8 carbon atoms; Y is a radical selected from the group consisting of fluorine and trifluoromethyl; and *n* is an integer of 0 to about 3, said hydrolyzed copolymer having an equivalent weight of from about 900 to about 1,600.

3. The method of claim 2 in which said R is a fluorine radical and said Y is a trifluoromethyl radical.

4. The method of claim 3 in which said hydrolyzed copolymer of said perfluoroolefin and said fluorosulfonated perfluorovinyl ether has an equivalent weight of from about 1,100 to about 1,500 and said hydrolyzed copolymer is reinforced by a polytetrafluoroethylene cloth.

5. The method of claim 4 in which said alkali metal chloride solution is a sodium chloride solution at a concentration of from about 50 grams per liter to about 320 grams per liter.

6. The method of claim 5 in which said pH of said sodium chloride solution is maintained at from about 3.5 to about 4.8.

7. The method of claim 6 in which said caustic liquor in said cathode compartment is sodium hydroxide maintained at a concentration of from about 50 to about 350 grams per liter.

8. The method of claim 7 in which said pH of said sodium chloride solution is maintained at from about 3.6 to about 4.4.

9. The method of claim 1 in which said alkali metal chloride is selected from the group consisting of lithium chloride, potassium chloride, sodium chloride, rubidium chloride, and cesium chloride.

10. In a method for controlling the flow properties of a porous diaphragm in an electrolytic cell for producing chlorine gas and a caustic liquor by the electrolysis of an alkali metal chloride solution, said electrolytic cell comprised of an anode compartment containing said alkali metal chloride solution and a cathode compartment containing said caustic liquor, said anode compartment separated from said cathode compartment by said porous diaphragm consisting essentially of a perfluorosulfonic acid resin having an acid form and an alkali metal salt form, said method being characterized by the improvement which comprises maintaining at least 95 percent of said perfluorosulfonic acid resin in said alkali metal salt form by soaking said perfluorosulfonic acid resin with said alkali metal chloride solution at a pH of from about 3.0 to about 5.0.

11. The method of claim 10 in which said alkali metal is selected from the group consisting of lithium, potassium, sodium, rubidium, and cesium.

* * * * *